US008230839B2

(12) United States Patent
Hayatani et al.

(10) Patent No.: US 8,230,839 B2
(45) Date of Patent: Jul. 31, 2012

(54) FUEL INJECTION VALVE

(75) Inventors: Masahiko Hayatani, Hitachinaka (JP); Motoyuki Abe, Hitachinaka (JP); Toru Ishikawa, Kitaibaraki (JP); Eiichi Kubota, Ishioka (JP); Takehiko Kowatari, Kashiwa (JP)

(73) Assignee: Hitachi, Ltd., Tokyo (JP)

( * ) Notice: Subject to any disclaimer, the term of this patent is extended or adjusted under 35 U.S.C. 154(b) by 528 days.

(21) Appl. No.: 12/438,668

(22) PCT Filed: Sep. 25, 2006

(86) PCT No.: PCT/JP2006/319623

§ 371 (c)(1),
(2), (4) Date: Oct. 14, 2009

(87) PCT Pub. No.: WO2008/038396

PCT Pub. Date: Apr. 3, 2008

(65) Prior Publication Data

US 2010/0065021 A1 Mar. 18, 2010

(51) Int. Cl.
*F02M 51/00* (2006.01)

(52) U.S. Cl. ..... 123/476; 239/585.5; 123/295

(58) Field of Classification Search ..... 123/295, 123/305, 472, 476–481, 490; 239/585.1–585.5, 239/533.2, 900; 251/129.12
See application file for complete search history.

(56) References Cited

U.S. PATENT DOCUMENTS 4,958,604 A * 9/1990 Hashimoto ..... 123/276
5,058,549 A * 10/1991 Hashimoto et al. ..... 123/298
(Continued)

FOREIGN PATENT DOCUMENTS

JP 58-178863 A 10/1983
(Continued)

OTHER PUBLICATIONS

Chinese Office Action dated Nov. 2, 2010 with partial English translation (seven (7) pages).

(Continued)

*Primary Examiner* — John T. Kwon
*Assistant Examiner* — Johnny Hoang
(74) *Attorney, Agent, or Firm* — Crowell & Moring LLP

(57) ABSTRACT

In a fuel injection valve used for an internal combustion engine, a valve closing lag time due to fluid resistance in a fuel path is shortened to decrease a minimum injection limit. More specifically, in the fuel injection valve in which an anchor is attracted to an end face part of a stationary core having a fuel path formed at a center part thereof by means of electromagnetic force, and in which a fuel injection hole is opened and closed by controlling a valve disc driven in conjunction with the anchor, there are provided a fuel reservoir part at a center part of an upper end face part of the anchor, a through hole extending axially in a fashion that an end part thereof is open to the fuel reservoir part, and a fuel path extending radially outward from the fuel reservoir part so that fuel is fed to a magnetic attraction gap between an upper end face part of the anchor and a lower end face part of the stationary core. Further, an opening part of a through hole that is open to an upper end face part of the anchor is at least partially opposed to a fuel introduction bore formed in the stationary core, and on the opening part of the through hole, a fuel introduction part is provided for capturing fuel running radially outward from a center side part of the anchor and for guiding the fuel thus captured to the through hole.

4 Claims, 9 Drawing Sheets

U.S. PATENT DOCUMENTS

| | | | | |
|---|---|---|---|---|
| 5,244,154 | A * | 9/1993 | Buchholz et al. | 239/590.3 |
| 5,632,467 | A | 5/1997 | Just et al. | |
| 5,636,796 | A * | 6/1997 | Oguma | 239/533.12 |
| 6,206,304 | B1 * | 3/2001 | Koseki et al. | 239/533.12 |
| 6,405,935 | B2 * | 6/2002 | Dantes et al. | 239/5 |
| 6,783,085 | B2 * | 8/2004 | Xu | 239/463 |
| 6,817,545 | B2 * | 11/2004 | Xu | 239/533.12 |
| 6,848,635 | B2 * | 2/2005 | Xu | 239/533.12 |
| 7,082,922 | B2 * | 8/2006 | Abe et al. | 123/305 |
| 7,168,637 | B2 * | 1/2007 | Goenka et al. | 239/497 |
| 7,774,126 | B2 * | 8/2010 | Abe et al. | 701/104 |
| 2006/0027682 | A1 | 2/2006 | Aoki et al. | |

FOREIGN PATENT DOCUMENTS

| | | | |
|---|---|---|---|
| JP | 11-22585 | A | 1/1999 |
| JP | 2000-55229 | A | 2/2000 |
| JP | 2002-528672 | A | 9/2002 |
| JP | 2002-295329 | A | 10/2002 |
| JP | 2005-139971 | A | 6/2005 |
| JP | 2005-163712 | A | 6/2005 |
| JP | 2006-22721 | A | 1/2006 |
| JP | 2006-22727 | A | 1/2006 |

OTHER PUBLICATIONS

International Search Report dated Jan. 9, 2007 with a partial English translation (Four (4) pages).

European Search Report dated May 13, 2011 (three (3) pages).

European Office Action dated Jun. 30, 2011 (five (5) pages).

Chinese Office Action including English translation dated Nov. 9, 2011 (Sixteen (16) pages).

* cited by examiner

FUEL INJECTION VALVE

BACKGROUND OF THE INVENTION

1. Field of the Invention

The present invention relates to a fuel injection valve used in an internal combustion engine, and more particularly to a fuel injection valve that opens and closes a fuel path by an electromagnetically driven movable member thereof.

2. Description of the Related Art

A conventional type of fuel injection valve is disclosed in Japanese Unexamined Patent Publication No. H11 (1999)-22585, which describes a technique for improving valve behavior responsivity through reduction of fluid resistance in movement of an anchor by providing a vertical groove on the periphery of the anchor.

In Japanese Unexamined Patent Publications No. S58 (1983)-1778863 and No. H18 (2006)-22721, there is disclosed a movable member comprising a cylindrical anchor part, a plunger part located at the center part of the anchor part, and a valve disc mounted at the top end of the plunger part, wherein a magnetic attraction gap is provided between an end face of the anchor part and an end face of a stationary core having a fuel introduction bore for introducing fuel centerward, and wherein an electromagnetic coil is provided for applying a magnetic flux to a magnetic path including the magnetic attraction gap. A technique for forming an axially extending through hole in the anchor part is also described in the patent publications noted above.

Japanese Unexamined Patent Publication No. H14 (2002)-528672 discloses a structure in which a plunger is disposed through the center of an anchor part, and an axially extending through hole that penetrates the anchor part is provided in the periphery portion of the anchor part.

SUMMARY OF THE INVENTION

In the conventional techniques described above, fluid resistance in a fuel path disposed in an anchor has an adverse effect on movement of the anchor, resulting in unsatisfactory improvement in responsivity at the time of valve opening or closing.

It is therefore an object of the present invention to increase a response speed of valve opening and closing in a fuel injection valve by enabling sufficiently smooth movement of a movable member including an anchor so that fuel fed from a fuel introduction bore of a stationary core to the anchor can smoothly run to the downstream side of the anchor or so that, under particular conditions, fuel can smoothly move from the downstream side of the anchor to the upstream side thereof.

In accomplishing this object of the present invention and according to one aspect thereof, there is provided a fuel injection valve in which an opening part of a through hole that is open to the upper end face of an anchor is disposed at a position that is at least partially opposed to a fuel introduction bore of a stationary core, and a fuel introduction part is provided at the opening part of the through hole so that fuel flowing outward from the center side of the anchor is captured and guided to the through hole.

The length of the through hole is preferably shorter than the axial dimension of the anchor, and at the upper end part (stationary core side) of the through hole, the fuel introduction part is preferably formed so as to be open centerward in addition to the provision of the opening part opposed to the stationary core.

A fuel injection valve structured as mentioned above in accordance with the present invention can provide enhanced responsivity of valve opening and closing.

The above and other objects, features and advantages of the present invention will become more apparent from the following detailed description with reference to the accompanying drawings.

DETAILED DESCRIPTION OF THE PREFERRED EMBODIMENTS

Figure 1:
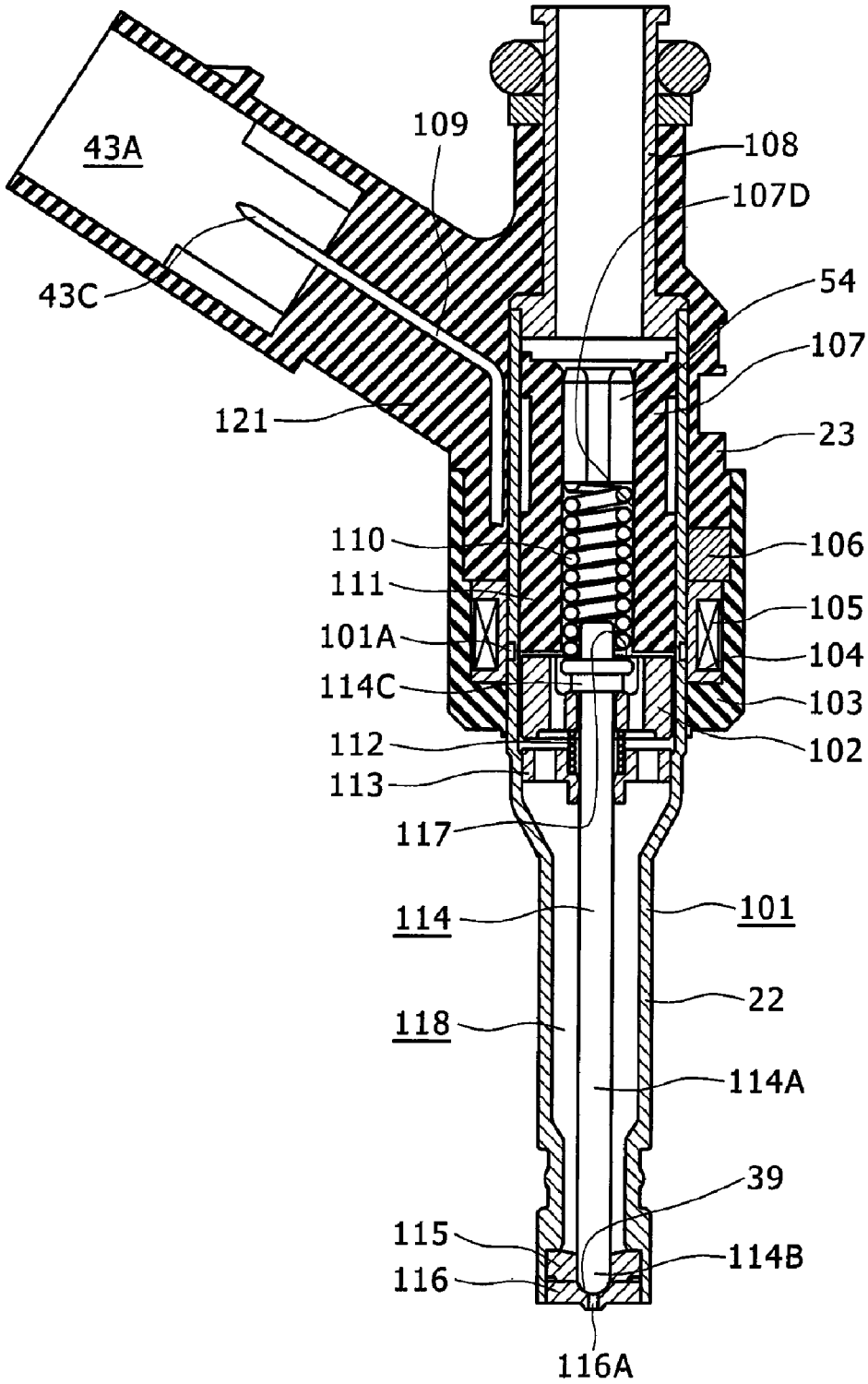
FIG. 1 is a sectional view showing an entire structural arrangement of a fuel injection valve in a preferred embodiment of the present invention.
Figure 2:
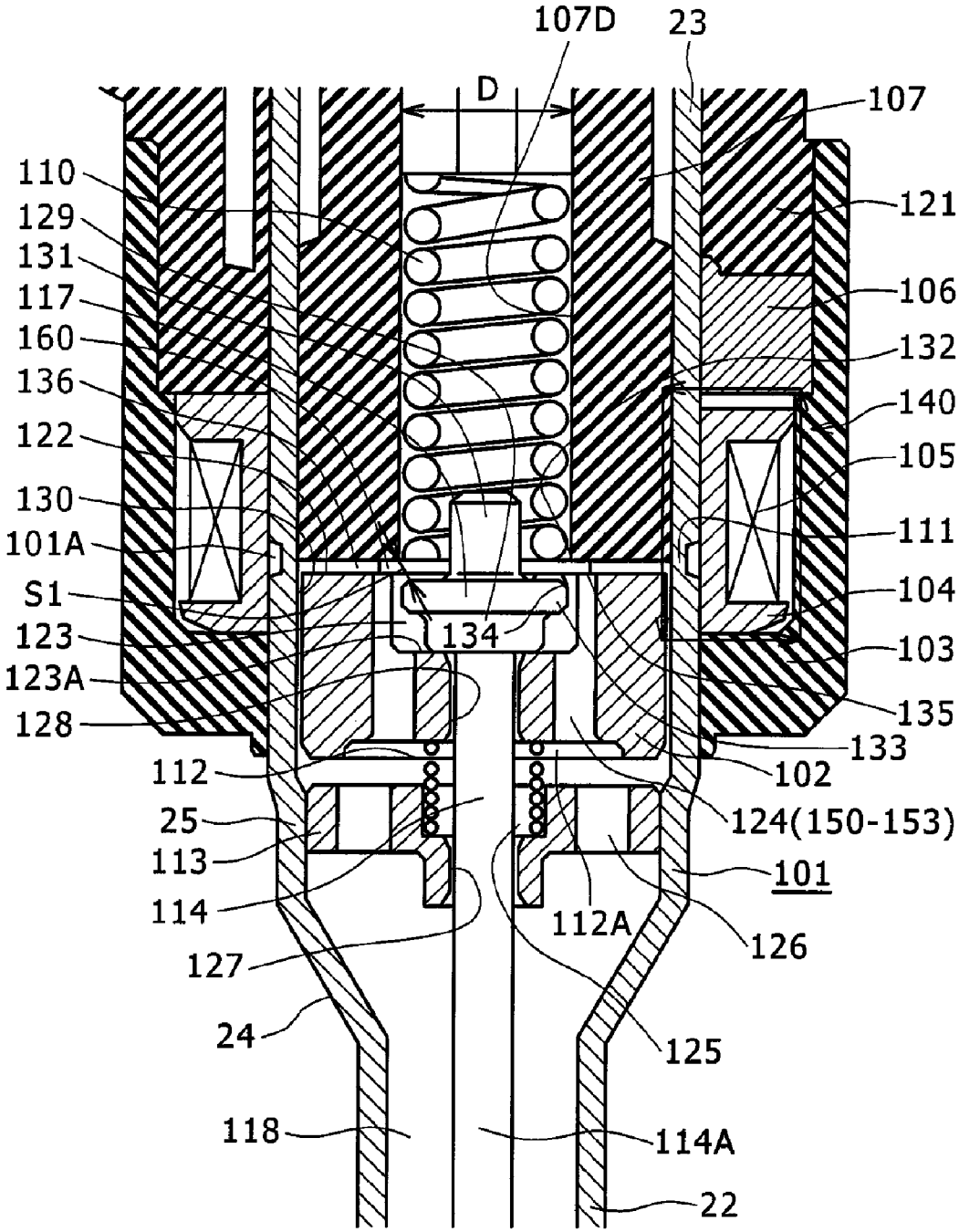
FIG. 2 is an enlarged fragmentary sectional view showing a part of FIG. 1.

The present invention will now be described in detail by way of example with reference to the accompanying drawings. Referring first to FIGS. 1 and 2, there is shown an entire structural view of a first preferred embodiment of the present invention to be described below.

FIG. 1 is a longitudinal cross-section view of a fuel injection valve in the first preferred embodiment, and FIG. 2 is an enlarged view of a part of FIG. 1, showing details of the fuel injection valve in the first preferred embodiment.

A nozzle pipe 101 made of metal comprises a small-diameter cylindrical part 22 having a relatively small diameter and a large-diameter cylindrical part 23 having a relatively large diameter, both the cylindrical parts 22 and 23 being joined with ether other via a conical section part 24.

A nozzle tip is formed at an end of the small-diameter cylindrical part 22. More specifically, on an internal cylindrical region formed at the end of the small-diameter cylindrical part 22, a guide member 115 having a guide bore for guiding fuel centerward and an orifice plate 116 having a fuel injection hole 116A are stacked and inserted in that order, and the periphery of the orifice plate 116 is secured to the internal cylindrical region by welding.

The guide member 115 serves to guide movement of a plunger 114A of a movable member 114 to be described later, i.e., movement of a valve disc 114B provided at an end of the plunger 114A, and the guide member 115 also serves to guide fuel inward from the radially outer side of the valve disc 114B.

The orifice plate 116 has a conical valve seat 39 formed at a position facing the guide member 115. The valve disc 114B provided at the end of the plunger 114A is moved to abut the valve seat 39 or to come off the valve seat 39 so that a flow of fuel is cut off from the fuel injection hole 116A or injected therethrough.

On the periphery of the nozzle tip, there is formed a groove in which a tip seal made of resin or a seal member represented by a gasket having rubber material plated on a metal part thereof is press-fitted.

At the lower end of the inner circumference of the large-diameter cylindrical part 23 of the metallic nozzle pipe 101, a plunger guide 113 for guiding the plunger 114A of the movable member 114 is securely press-fitted with a drawn part 25 of the large-diameter cylindrical part 23.

At the center of the plunger guide 113, a guide bore 127 is provided for guiding the plunger 114A, and a plurality of fuel paths 126 are formed around the guide bore 127.

Further, on the upper side of the center of the plunger guide 113, a recessed part 125 is formed by extrusion processing. A spring 112 is held in the recessed part 125.

On the lower side of the center of the plunger guide 113, a protruded part corresponding to the recessed part 125 is formed by extrusion processing so that the guide bore 127 for the plunger 114A is provided at the center of the protruded part.

Thus, the plunger 114A, which has an elongated shape, is guided by the guide bore 127 of the plunger guide 113 and the guide bore of the guide member 115 to perform straight reciprocating motion.

Since the metallic nozzle pipe 101 is formed as an integral member including the top end portion and back end portion thereof in the arrangement mentioned above, the nozzle pipe 101 is easy to manage as a component part and advantageous in workability at the time of assembling at a workshop.

At the opposite end of the plunger 114A from the end thereof having the valve disc 114B, there is provided a head part 114C comprising stepped parts 129 and 133 that have an outside diameter larger than the diameter of the plunger 114A. A seat face for a spring 110 is provided on the upper end face of the stepped part 129, and a protrusion 131 used as a spring guide is formed at the center thereof.

The movable member 114 comprises an anchor 102 which has, at the center thereof, a plunger through hole 128 for penetration of the plunger 114A.

On the anchor 102, a recessed part 112A is formed as a spring bracket seat at the center of the face opposed to the plunger guide 113, and the spring 112 is held between the recessed part 112A and the recessed part 125 of the plunger guide 113.

Since the plunger through hole 128 has a diameter smaller than the diameters of the stepped parts 133 and 129 formed on the head part 114C, the lower end face of the inner circumference of the stepped part 129 formed on the head part 114C of the plunger 114A abuts a bottom face 123A of a recessed part 123 formed on the upper side face of the anchor 102 held by the spring 112 under the action of a biasing force of the spring 110 that pushes the plunger 114A toward the valve seat of the orifice plate 116 or under the action thereof in combination with the influence of gravity, thereby bringing about engagement between the plunger 114A and the anchor 102.

Thus, both the plunger 114A and anchor 102 are operatively associated to move together in upward movement of the anchor 102 against the biasing force of the spring 112 or the force of gravity, or in downward movement of the plunger 114A along the biasing force of the spring 112 or the force of gravity.

In contrast, when a force of moving the plunger 114A upward is applied thereto independently or when a force of moving the anchor 102 downward is applied thereto independently, the plunger 114A and the anchor 102 are to be moved in directions opposite to each other regardless of the biasing force of the spring 112 or the force of gravity.

In this step of operation, a film of fluid existing in a micro gap of 5 to 15 micrometers between the outer circumferential face of the plunger 114A and the inner circumferential face of the anchor 102 at the location of the plunger through hole 128 produces friction against the opposite-direction movements of the plunger 114A and the anchor 102, causing suppression of the movements thereof. That is to say, a braking force is applied to rapid displacements of the plunger 114A and the anchor 102. There occurs little frictional resistance in slow movements of the plunger 114A and the anchor 102, and therefore, momentary opposite-direction movements of the plunger 114A and the anchor 102 attenuate in a short time.

In the state mentioned above, the center position of the anchor 102 is held by the inner circumferential face of the plunger through hole 128 of the anchor 102 and the outer circumferential face of the plunger 114A, not by the inner circumferential face of the large-diameter cylindrical part 23 and the outer circumferential face of the anchor 102. The outer circumferential face of the plunger 114A serves as a guide for the anchor 102 in independent axial movement thereof.

Although the lower end face of the anchor 102 is opposed to the upper end face of the plunger guide 113, there occurs no direct contact between the lower end face of the anchor 102 and the upper end face of the plunger guide 113 because of the intervention of the spring 112.

A side gap 130 is provided between the outer circumferential face of the anchor 102 and the inner circumferential face of the large-diameter cylindrical part 23 of the metallic nozzle pipe 101. For allowing axial movement of the anchor 102, the side gap 130 is so arranged as to provide a clearance dimension of approximately 0.1 millimeter for example, which is larger than the micro gap of 5 to 15 micrometers between the outer circumferential face of the plunger 114A and the inner circumferential face of the anchor 102 at the location of the plunger through hole 128. Since an increase in the size of the side gap 130 tends to increase magnetic resistance, the size of the side gap 130 is to be determined in consideration of an effect of magnetic resistance.

A stationary core 107 is press-fitted on the inner circumferential face of the large-diameter cylindrical part 23 of the metallic nozzle pipe 101, and a fuel introduction pipe 108 is press-fitted on the upper end face of the stationary core 107. Weld-jointing is made at a press-fitted position between the large-diameter cylindrical part 23 of the nozzle pipe 101 and the fuel introduction pipe 108 so as to hermetically seal a fuel leakage clearance to be formed between the inside of the large-diameter cylindrical part 23 of the metallic nozzle pipe 101 and outside air.

Along the center line of the fuel introduction pipe 108 and the stationary core 107, there is provided a through hole 107D having a diameter D that is slightly larger than the diameter of the head part 114C of the plunger 114A.

At the lower end of the inner circumference of the through hole 107D used as a fuel introduction path in the stationary core 107, the head part 114C of the plunger 114A is inserted in a non-contact state, and between a lower end edge 132 of the inner circumference of the through hole 107D in the stationary core 107 and an outer circumferential edge 132 of the stepped part 133 of the head part 114C, there is provided a gap S1 having almost the same size as that of the side gap 130 mentioned above. In this arrangement, a clearance dimension larger than a gap of approximately 40 to 100 micrometers on an inner circumferential edge 135 of the anchor 102 is provided in order to minimize magnetic flux leakage from the stationary core 107 to the plunger 114A.

For initial load setting, the lower end of the spring 110 abuts a spring bracket seat 117 formed on the upper end face of the stepped part 133 provided on the head part 114C of the plunger 114A, and the other end of the spring 110 is placed on an adjuster 54 press-fitted in the inside of the through hole 107D of the stationary core 107 so that the spring 110 is held between the head part 114C and the adjuster 54.

By adjusting a setting position of the adjuster 54, it is possible to adjust an initial load to be applied when the spring 110 pushes the plunger 114A against the valve seat 39.

At the time of stroke adjustment of the anchor 102, an electromagnetic coil (104, 105) and a yoke (103, 106) are attached to the periphery of the large-diameter cylindrical part 23 of the nozzle pipe 101, and then the anchor 102 is set in the inside of the large-diameter cylindrical part 23 of the nozzle pipe 101. With the plunger 114A inserted through the anchor 102, the plunger 114A is pressed to a valve closing position by using a jig, and a position of press-fitting the stationary core 107 is determined while a stroke of the movable member 114 is checked when the electromagnetic coil 105 is energized. In this manner, the stroking of the movable member 114 can be adjusted to an arbitrary position.

As shown in FIGS. 1 and 2, with an initial load of the spring 110 adjusted in initial load setting, the lower end face of the stationary core 107 is opposed to an upper end face 122 of the anchor 102 of the movable member 114 via a magnetic attraction gap 136 of approximately 40 to 100 micrometers (slightly exaggerated for purposes of illustration). In comparison between the outside diameter of the anchor 102 and the outside diameter of the stationary core 107, the outside diameter of the anchor 102 is slightly (approximately 0.1 millimeter) smaller than that of the stationary core 107. By way of contrast, the inside diameter of the plunger through hole 128 formed at the center of the anchor 102 is slightly larger than the diameters of the plunger 114A and valve disc 114B of the movable member 114. The inside diameter of the through hole 107D formed in the stationary core 107 is slightly larger than the outside diameter of the head part 114C, which is larger than the inside diameter of the plunger through hole 128 of the anchor 102.

In the structure mentioned above, while an adequate area of magnetic passage is provided in the magnetic attraction gap 136, an allowance for axial engagement is provided between the lower end face of the head part 114C of the plunger 114A and the bottom face 123A of the recessed part 123 of the anchor 102.

On the periphery of the large-diameter cylindrical part 23 of the metallic nozzle pipe 101, a cup-shaped yoke 103 having an open-side mouth is provided, and a toroidal upper yoke 106 is secured so as to cover the open-side mouth of the cup-shaped yoke 103.

At the center of the bottom part of the cup-shaped yoke 103, a through hole is provided, and the large-diameter cylindrical part 23 of the metallic nozzle pipe 101 is inserted through the through hole. On an outer circumferential wall part of the cup-shaped yoke 103, an outer circumferential yoke part is formed which is opposed to the outer circumferential face of the large-diameter cylindrical part 23 of the metallic nozzle pipe 101. The outer circumferential face of the toroidal upper yoke 106 is press-fitted with the inner circumferential face of the cup-shaped yoke 103.

In a cylindrical space formed by the cup-shaped yoke 103 and the toroidal upper yoke 106, there is disposed a toroidal or cylindrical electromagnetic coil 105.

The electromagnetic coil 105 comprises a toroidal coil bobbin 104 having a U-shaped groove that is open radially outward, and a toroidal coil element 105 formed of a copper wire wound in the U-shaped groove.

The bobbin 104, coil element 105, cup-shaped yoke 103, and upper yoke 106 are included in an electromagnetic coil device arrangement.

A rigid conductor 109 is secured to each of the beginning of the coil element 105 and the end thereof, and the conductor 109 is led out via a through hole formed in the upper yoke 106. The peripheries of the conductor 109, the fuel introduction pipe 108, and the large-diameter cylindrical part 23 of the nozzle pipe 101 are molded in a process in which insulating resin is injected into the upper part of the upper yoke 106 on the inner circumference of an opening on the upper end of the cup-shaped yoke 103. Thus, the peripheries of the conductor 109, the fuel introduction pipe 108, and the large-diameter cylindrical part 23 of the nozzle pipe 101 are covered with resin mold 121. In this manner, a toroidal magnetic path 140 indicated by the arrow 140 in FIG. 2 is formed around the electromagnetic coil (104, 105).

A plug for supplying electric power from a battery power supply is connected to a connector 43A formed at the top end part of a conductor 43C, and a sequence of energization and non-energization is controlled by a controller (not shown).

When the coil 105 is energized, a force of magnetic attraction is produced in the magnetic attraction gap 136 between the anchor 102 of the movable member 114 and the stationary core 107 by a magnetic flux passing through the magnetic path 140, causing the anchor 102 to move upward since the attractive force thus produced exceeds a preset load of the spring 110. In this step of operation, the anchor engages the head part 114C of the plunger 114A, and moves upward in conjunction with the plunger 114A until the upper end face of the anchor 102 abuts the lower end face of the stationary core 107. Accordingly, the valve disc 114B at the top end of the plunger 114A comes off the valve seat 39, so that fuel is run through a fuel path 118 and injected into a combustion chamber via a plurality of the fuel injection holes 116A.

When the electromagnetic coil 105 is de-energized, the magnetic flux passing through the magnetic path 140 disappears to remove the force of magnetic attraction from the magnetic attraction gap 136.

In this state, a biasing force of the spring 110 for initial load setting, which pushes the head part 114C of the plunger 114A in the opposite direction, overcomes a biasing force of the spring 112, acting on the movable member 114 entirely (anchor 102, plunger 114A). Resultantly, the anchor 102 of the movable member 114, from which the force of magnetic attraction has been removed, is returned to the valve closing position where the valve disc 114B comes into contact with the valve seat 39.

In this step of operation, the stepped part 129 of the head part 114C abuts the bottom face 123A of the recessed part 123 of the anchor 102, causing the anchor 102 to be moved toward the plunger guide 113 with a force overcoming the biasing force of the spring 112.

When the valve disc 114B strikes the valve seat 39 vigorously, the plunger 114A bounces off in a direction of compressing the spring 110. However, since the anchor 102 is provided as a component independent of the plunger 114A, the plunger 114A leaves the anchor 102 to move in the opposite direction from the movement of the anchor 102.

Under this condition, friction is produced on a fluid between the outer circumferential face of the plunger 114A and the inner circumferential face of the anchor 102, so that the kinetic energy of bouncing-off of the plunger 114A is absorbed by an inertial mass of the anchor 102 which is still in movement to the opposite direction (valve closing direction) due to an inertial force of the anchor 102.

At the time of bouncing-off of the plunger 114A, since the anchor 102 having a relatively large inertial mass separates from the plunger 114A, the energy of bouncing-off itself decreases. Further, when the anchor 102 absorbs the energy of bouncing-off of the plunger 114A, the inertial force of the anchor 102 decreases accordingly to reduce the energy of compressing the spring 112, causing a decrease in repulsive force of the spring 112. Thus, there hardly occurs a phenomenon of movement of the plunger 114A in the valve opening direction due to the bouncing-off of the anchor 102 itself.

In the manner mentioned above, the bouncing-off of the plunger 114A is minimized, i.e., a phenomenon of so-called secondary injection is suppressed in which fuel is injected randomly by valve opening immediately after de-energization of the electromagnetic coil (104, 105).

In the design of a fuel injection valve, it is required that the fuel injection valve be able to perform valve opening and closing actions in quick response to an input valve opening signal. More specifically, a lag time from the rise of a valve opening pulse signal until the accomplishment of an actual open valve state (valve opening lag time) and a lag time from the fall of the valve opening pulse signal until accomplishment of an actual closed valve state (valve closing lag time) should be shortened, which is also of key importance from the viewpoint that a minimum controllable fuel injection quantity (minimum injection limit) should be decreased. It is commonly known that the shortening of a valve closing lag time is effective in decreasing the minimum injection limit.

As a technique for shortening a valve closing lag time, it is conceivable to increase a preset load of the spring 110 to be applied to the movable member 114 as a force for transition from an open state of the valve disc 114B to a closed state thereof. However, an increase in this force results in the need for increasing a valve opening force, giving rise to the disadvantageous problem that a larger-sized electromagnetic coil must be used. Because of a limitation imposed on structural design of a fuel injection valve, the technique stated above can achieve only a limited success in shortening a valve opening lag time.

As another technique for shortening a valve closing lag time, an arrangement based on the following principle of operation can be proposed: When the anchor 102 attracted by a force of electromagnetic attraction of the stationary core 107 is pushed downward by the spring 110, the magnetic attraction gap 136 between the lower end face of the stationary core 107 and the upper end face 122 of the anchor 102 is put in a negative pressure state. By utilizing this phenomenon, fuel thrusted aside by movement of the anchor 102 is made to flow quickly into the magnetic attraction gap 136 from the fuel path 118.

Described below is a preferred embodiment of the present invention based on the above-mentioned principle of operation. In the present preferred embodiment, for shortening a valve closing lag time, a through hole for fuel passage 124 (150 to 153) is provided in the anchor 102 so that fuel flows in the axial direction thereof, an opening part of the through hole open to the upper end face of the anchor 102 is disposed at a position that is at least partially opposed to the fuel introduction bore 107D of the stationary core 107, and a fuel introduction part is provided at the opening part of the through hole so that fuel flowing outward from the center side of the anchor 102 is captured and guided to the through hole.

The length of the through hole is preferably shorter than the axial dimension of the anchor 102, and at the upper end (stationary core side) of the through hole, the fuel introduction part is preferably formed so as to be open centerward in addition to the provision of the opening part opposed to the lower end face of the stationary core 107.

Figure 3A:
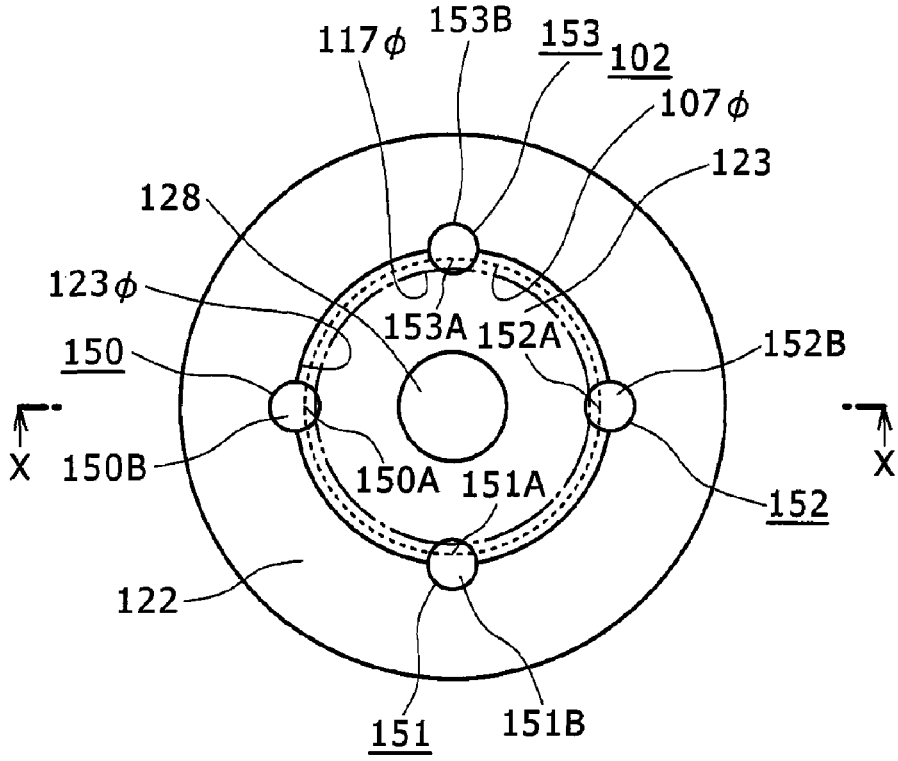
FIG. 3 presents a plan view showing an anchor in a preferred embodiment of the present invention and a sectional view showing the center part of the anchor.
Figure 3B:
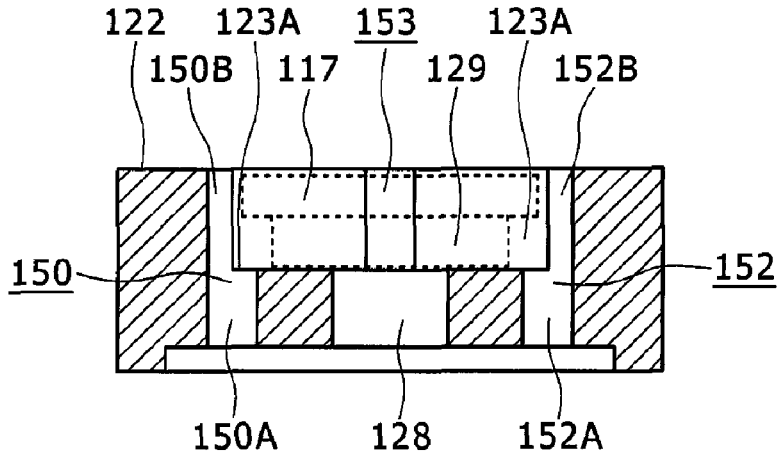

FIG. 3 shows the structure of the anchor 102 in the present preferred embodiment of the invention. FIG. 3(A) is a plan view taken from the plunger head part 114C, and FIG. 3(B) is a sectional view of (A) taken along the line X-X.

At the center part of the anchor 102, the recessed part 123 is provided, and at the center part of the bottom face 123A thereof, the plunger through hole 128 is formed for penetration of the plunger 114A of the movable member 114.

Four vertical grooves 150B to 153B, each having a semicircular cross section and constituting a part of each of the through holes 150 to 153 for fuel passage, are formed at equally spaced intervals on an inner circumferential wall part of the recessed part 123. Located at the upper positions of the through holes 150 to 153, the vertical grooves 150B to 153B serve as a fuel introduction part for capturing fuel flowing outward from the center side of the anchor 102.

The vertical grooves 150B to 153B run to the bottom face 123A of the recessed part 123, being straight open on the end face opposite to the stationary core side of the anchor 102. Each of the portions extending from the vertical grooves 150B to 153B through the bottom face 123A is formed to provide a circular cross section as a part of each of the through holes 150 to 153. As arranged in the fashion mentioned above, on the bottom face 123A, there are provided through holes 150A to 153A each having a semicircular cross section that projects centerward from the outer circumference of the bottom face 123A. Although each of the through holes 150 to 153 having a circular cross section is formed by a combination of each of the through holes 150A to 153A having a semicircular cross section and each of the vertical grooves 150B to 153B having a semicircular cross section in the present preferred embodiment, a diametrical dimension of each of the through holes 150A to 153A having a semicircular cross section may be larger or smaller than a diametrical dimension of each of the vertical grooves 150B to 153B having a semicircular cross section. There may also be provided such an arrangement that each of the cross sections of the through holes 150A to 153B and the vertical grooves 150B to 153B has a rectangular or any other shape. That is to say, each of the through holes 150 to 153 should be formed in a stepped structure so that at least a part thereof is open on the bottom face of the recessed part 123 of the anchor 102 or open at any midway position recessed from the end face 112 of the anchor 102, and so that the remaining part thereof is open on the end face 112 of the anchor 102 or open at a position that is nearer to the end face 122 of the anchor 102 than the above-stated open part that is located on the bottom face of the recessed part 123 or at any recessed midway position. In this structural arrangement, fuel is captured by each of the vertical grooves 150B to 153B serving as an fuel introduction part, and the fuel thus captured is guided to each of the through holes 150A to 153A, thereby ensuring smooth fuel flowing to enhance the responsivity of the anchor 102.

A part of each of the through holes 150 to 153 is formed at an inner position radially inward from the diameter of the fuel introduction bore 107D of the stationary core 107, and the remaining part thereof is formed at an outer position radially outward from the diameter of the fuel introduction bore 107D. In this arrangement, the position of opening at the upper end of each of the through holes 150 to 153 located at the inner position radially inward from the fuel introduction bore 107D is disposed at a position that is farther apart from the end face of the stationary core 107 than the position of opening at the upper end of each of the through holes 150 to 153 located at an outer position radially outward from the fuel introduction bore 107D.

In the present preferred embodiment structured as described above, fuel running from the fuel introduction bore 107D flows into each of the through holes 150 to 153, and also the fuel flows over the opening of each of the through holes 150 to 153 to run toward the radially outer side of the end face of the anchor 102, thereby enabling quick fuel movement in the magnetic attraction gap.

In FIG. 3, the solid line 123*o* indicates the diameter of the recessed part 123, representing the inner circumferential wall of the recessed part 123. The broken line 107ø indicates the inside diameter of the fuel introduction bore 107D of the stationary core 107, and the dot-dash line 117Ø indicates the outside diameter of the spring bracket seat 117 formed on the head part 114C of the plunger 114A. As shown in FIGS. 3 and 2, in introduction of fuel from the lower end of the stationary core 107 to the recessed part 123, the fuel is fed via the gap S1 formed as a fuel path formed between the edge 132 of the inner circumference of the stationary core 107 and an edge 134 of the outer circumference of the upper end of the spring bracket seat 117. Since the opening of each of the through holes 150 to 153 is formed at an immediately downstream position of the fuel path (almost directly below the fuel path), smooth fuel flowing can be ensured. Further, fuel running through each of the through holes 150 to 153 from the fuel path 118 also flows smoothly into the magnetic attraction gap 136 in a negative pressure state between the end face 112 of the anchor 102 and the end face of the stationary core 107. That is, smooth fuel movement is allowed because of the formation of an almost straight way of fuel passage from the fuel introduction bore 107D to the fuel path 118. Further, as regards the magnetic attraction gap 136 between the end face 122 of the anchor 102 and the end face of the stationary core 107, since a part of each of the through holes 150 to 153 is extended in such a shape that the recessed part 123 expands radially outward, fuel from the gap S1 between the edge 132 of the inner circumference of the stationary core 107 and the edge 134 of the outer circumference of the upper end of the spring bracket seat 117 and fuel from the recessed part 123 are fed smoothly into the magnetic attraction gap 136 between the end face 122 of the anchor 102 and the end face of the stationary core 107.

In this arrangement, the sum total of the cross-sectional path areas of the through holes 150 to 153 is larger than the cross-sectional path area of the fuel path formed in the gap S1, so that a cross-sectional area in the direction of fuel flow is widened to allow smoother flowing of fuel.

Further, since the recessed part 123 is provided as a broadened part of fuel passage at a downstream position with respect to the cross-sectional path area of the fuel path formed in the gap S1, fuel running through the gap S1 is fed smoothly into the through holes 150 to 153 and also into the magnetic attraction gap 136. At this step, the upper end part of each of the grooves 150B to 153B serves to feed fuel smoothly from the recessed part 123 to the recessed part 122 on the outer circumferential side of the anchor 102 through each of recessed parts 160 to 163.

The depth dimension of the recessed part 123 is to be determined appropriately according to the height dimension of the head part 114C of the plunger 114A.

Although the diameter of the recessed part 123 should be larger than the inside diameter of the stationary core 107, it is necessary to determine an extent of increase in the diameter of the recessed part 123 in consideration of magnetic characteristics with respect to the stationary core 107. In an example of embodiment in which the diameter of the recessed part 123 is expanded to the outermost diameter positions of the through holes 150 to 153, it has been found that satisfactory magnetic characteristics can be attained.

Further, there is provided such an arrangement that the sum total of the cross-sectional path areas of the through holes 150 to 153 is larger than the cross-sectional area of the plunger through hole 128 for penetration of the plunger 114A.

Thus, the cross-sectional area of fuel passage can be made larger than that in the case of provision of a through hole in the plunger. According to the structure demonstrated in the present preferred embodiment, there may also be provided a modification in which a through hole is formed at the center position of the plunger 114A or at an outer circumferential position thereof so as to widen the cross-sectional area of fuel passage.

In particular, where the through holes 150 to 153 formed in the anchor 102 and the fuel path 126 formed in the plunger guide 113 are aligned circumferentially and radially at the time of assembling, a straight fuel path can be formed from the fuel introduction bore of the stationary core to the fuel path 118 on the downstream side of the plunger guide 113, thereby making it possible to provide entirely smooth movement of the movable member 114 including the anchor 102.

Figure 4:
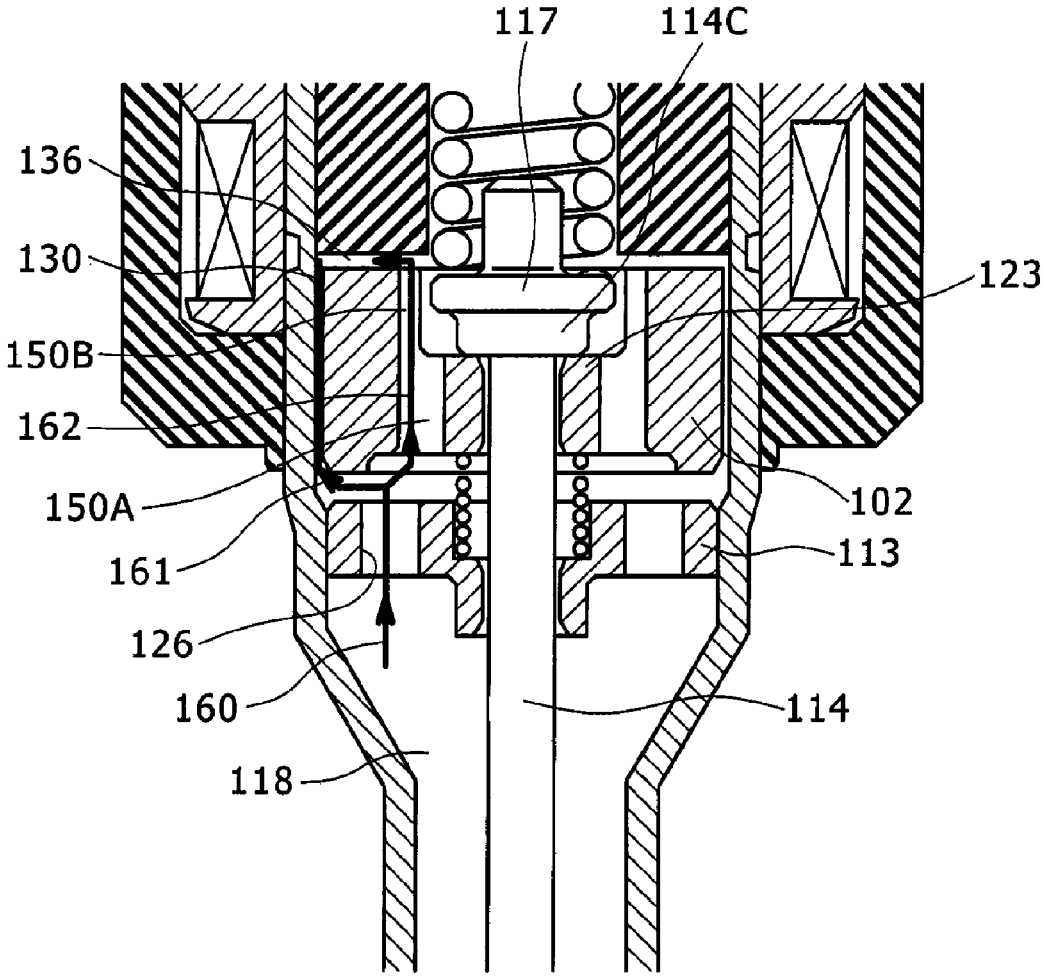
FIG. 4 is a sectional view showing flows of fuel at the time of closing an injection hole.

FIG. 4 shows a sectional view of the anchor 102 assembled in a fuel injection valve. The upper end face 122 of the anchor 102 is opposed to the stationary core 107 via the magnetic attraction gap 136, and the lower end face thereof is opposed to the plunger guide 113 via the fuel path. Further, on the bottom face 123A of the recessed part 123, the head part 114C of the movable member 114 is located, and the spring bracket seat 117 is located on the upper part thereof (indicated by the broken line in FIG. 3 (B)).

The following describes flows of fuel at the time of valve closing with reference to FIG. 4.

In a common application of a fuel injection valve used in a gasoline internal combustion engine of a cylinder direct injection type where fuel is fed at high pressure, fluid resistance on fuel passage has little effect on a valve opening lag time in valve opening operation for fuel injection since fuel is pressed a high pressure.

By way of contrast, when the valve disc 114B closes the fuel injection hole 116A in valve closing operation for cutting fuel off, a proportion of fuel thrusted against the direction of fuel fed at high pressure causes a counterflow. It is therefore required that fluid resistance on fuel passage be adequately small.

With reference to FIG. 4, the valve closing operation is described below using the through hole 150 of the anchor 102 as a representative portion of fuel passage.

When the valve opening pulse signal falls, a force of magnetic attraction is removed from the magnetic path 140, releasing the anchor 102 from attraction toward the stationary core 107. Then, the anchor 102 is pushed downward by a pushing force of the spring 110, thereby causing the valve disc 114B to close the injection hole 116A to cut fuel off.

When the valve disc 114B is pushed down to close the injection hole 116A, fuel thrusted in reverse 160 reaches the lower end of the anchor 102 through the fuel path 126 of the plunger guide 113. Then, the fuel branches into a flow of fuel 161 going to the side gap 130 of the anchor 102 and a flow of fuel going to the through hole 150 of the anchor 102. Since the side gap 130 is as narrow as approximately 0.1 millimeter, the fluid resistance of the side gap 130 is large and the quantity of fuel fed into the magnetic attraction gap 136 through the side gap 130 is extremely small. Therefore, little contribution to improvement in a valve closing lag is expected by rearranging the side gap 130.

Almost all of fuel 202 (162) flowing into the through hole 150A is fed to the vertical groove 150B having a semicircular cross section on the inner circumferential face of the recessed part 123 of the anchor 102 since the through hole 150A communicates directly with the vertical groove 150B.

The vertical groove 150B having a semicircular cross section on the inner circumferential face of the recessed part 123 of the anchor 102 is formed to have direct communication with the through hole 150A in a fashion that the vertical groove 150B overlaps with a part of the circumference of the through hole 150A, i.e., the formation of a semicircular groove corresponding to the diameter of the cross section of the through hole 150A is made on the side face of the bottom face 123A of the recessed part 123. Hence, on the overlapped part of the through hole 150A and the vertical groove 150B having a semicircular cross section on the inner circumferential face of the recessed part 123 of the anchor 102, there is no obstacle causing any particular fluid resistance, allowing quick flowing of fuel.

The fuel 202 flowing into the through hole 150A runs to the vertical groove 150B having a semicircular cross section on the inner circumferential face of the recessed part 123 of the anchor 102 and to the bottom face 123A of the recessed part 123 of the anchor 102. On the upper part of the bottom face 123A of the recessed part 123, protrusions such as the head part 114C of the movable member 114 and the spring bracket seat 117 are disposed to cause substantial fluid resistance. Therefore, most of the fuel 202 is fed to the vertical groove 150B having a semicircular cross section on the inner circumferential face of the recessed part 123 of the anchor 102.

At the fall of the valve opening pulse signal, the anchor 102 attracted by the force of magnetic attraction of the stationary core 107 is pushed down by the spring 110, causing a significant decrease in pressure in the magnetic attraction gap 136 between the lower end face of the stationary core 107 and the upper end face 122 of the anchor 102.

Under the condition mentioned above, the magnetic attraction gap 136 is in a negative pressure state, and the anchor 102 becomes movable when the fuel 162 is drawn into the magnetic attraction gap 136. To facilitate fuel movement in the magnetic attraction gap 136, it is necessary to reduce fluid resistance of fuel passage by smoothening the flows of the fuel 160 and fuel 162. That is, the reduction in fluid resistance of fuel passage makes it possible to quicken a valve closing action.

While the present preferred embodiment has been described with respect to the through hole 150 as a representative portion of fuel passage, it is to be understood that fuel flows through each of the through holes 151, 152, and 153 in the same manner.

As aforementioned, in the through hole 150 formed in the anchor 102, the through hole 150A directly communicates with the vertical groove 150B having a semicircular cross section on the inner circumferential face of the recessed part 123 of the anchor 102, thereby providing an advantageous effect that the opening area of the through hole is substantially larger than the dimensional area thereof. Since the cross-sectional area of passage for fuel introduction is made larger adequately, the fluid resistance at the entry of the through hole is reduced to ensure smooth fuel flowing into the through hole. On the other hand, when the anchor 102 moves in the direction of closing the injection hole 116A, fuel 200 thrusted in the fuel path 118 is quickly moved to the recessed part 123 via the through holes 150A to 153A, so that the fuel is quickly fed into the magnetic attraction gap 136 from the opening of the upper end having a semicircular cross section, thereby providing an advantageous effect of shortening a valve closing lag time.

In the present preferred embodiment, the outermost part of the through hole (outside with respect to the axis of the fuel injection valve) is disposed at an outer position radially outward from the side face of the fuel path formed in the stationary core, and the vertical groove 150B having a semicircular cross section on the inner circumferential face of the recessed part 123 of the anchor 102 is disposed to face the magnetic attraction gap 136. Thus, smooth fuel feeding into the magnetic attraction gap 136 is made easily to reduce fluid resistance. Further, the through hole serves as a primary fuel path in the anchor 102, i.e., the through hole has a large cross-sectional area for fuel passage through the anchor 102. Hence, fuel feeding into the magnetic attraction gap 136 in response to movement of the anchor 102 is made via the through hole serving as the primary fuel path. As a result, a voluminal proportion of fuel thrusted at the time of movement of the anchor 102 is fed via the through hole, reducing fluid resistance in fuel passage to the magnetic attraction gap. A negative pressure occurring in the magnetic attraction gap is therefore decreased to reduce fluid resistance exerted on the anchor 102, thereby bringing out an advantageous effect of shortening a valve closing lag time.

It is to be noted, however, that such an advantageous effect as mentioned above cannot be obtained merely by providing the anchor 102 with the through hole facing the magnetic attraction gap. To ensure an adequate force of magnetic attraction, it is required to decrease the magnetic attraction gap, and in particular, the magnetic attraction gap is extremely small when the anchor 102 is attracted to set up a valve open state. Therefore, even if the through hole in the anchor has an adequate cross-section area, an aperture for the cross-sectional area of the primary flow path is provided as a cylindrical face region formed by the magnetic attraction gap and the opening edge of the through hole. Since the area of the aperture is extremely small, fuel passage facing the magnetic attraction gap is made unsatisfactory. To obviate this problem in the present invention, there is provided a fuel path on the side of the through hole, the fuel path being arranged to communicate with the recessed part formed on the anchor 102. In this structural arrangement, since the recessed part formed on the anchor 102 is in communication with the fuel path provided on the side of the through hole, the above-mentioned aperture at the magnetic attraction gap does not become a cause of limitation regarding the cross-sectional area of the primary flow path.

That is, at a position on the end face of the anchor 102 opposed to the lower end face of the stationary core, there is provided an opening which is in communication with the fuel introduction bore of the stationary core and also in communication with the through hole formed in the anchor 102.

More specifically, at the center of the upper end of the anchor 102, there is provided a fuel reservoir part (corresponding to the recessed part 123, for example) which has a cross-sectional area larger than that of the fuel introduction bore of the stationary core, and a fuel path connected with the fuel reservoir part is formed radially outwardly on the upper end face of the anchor 102 while the upper end of each of the through holes (150A to 153A) formed in the anchor 102 is structured to be open to the fuel reservoir part.

By the way, the anchor 102 is made of a material having a good workability suitable for forging such as magnetic stainless steel or the like. In fabrication practice wherein the through hole 150 is formed in the anchor 102 by punching or drilling after the forging of the anchor 102, the through hole 150A and the vertical groove 150B having a semicircular cross section on the inner circumferential face of the recessed part 123 of the anchor 102 can be processed at the same time since the through hole 150A and the vertical groove 150B are to be in communication with each other, thereby providing an advantageous effect of decreasing the number of processing steps. It is preferred that the vertical groove 150B having a semicircular cross section on the inner circumferential face of the recessed part 123 of the anchor 102 be formed to be larger than the through hole 150A. When the through hole 150A is formed by punching after the vertical groove 150B having a semicircular cross section on the inner circumferential face of the recessed part 123 of the anchor 102 is formed by forging, a clearance can be provided between a punching tool and the vertical groove 150B having a semicircular cross section on the inner circumferential face of the recessed part 123 of the anchor 102, which will contribute to easier fabrication of the anchor 102.

Further, the through hole 150 may be formed in the process of forging by setting a pin at the position thereof.

Although four through holes are disposed at equally spaced intervals in the anchor 102 shown in FIG. 3, the number of through holes and the cross-sectional area of each of the through holes are to be determined in consideration of the following relational conditions:

When a current is applied to the electromagnetic coil (104, 105), the anchor 102 is attracted toward the stationary core 107 to move the movable member 114 upward. In the case that the electromagnetic coil (104, 105) and the stationary core 107 are made to meet consistent characteristic specifications, a force of magnetic attraction increases with an increase in the area of the upper end face 122 of the anchor 102, i.e., by increasing the area of the upper end face 122 of the anchor 102, the amount of current to be applied to the electromagnetic coil (104, 105) for obtaining the same level of magnetic attraction can be reduced to realize electric power saving. Under the condition that the same level of current is applied to the electromagnetic coil (104, 105), the stationary core 107 and the anchor 102 can be made smaller by increasing the area of the upper end face 122 of the anchor 102, thereby enabling reduction in the size of the fuel injection valve.

In contrast, as for flows of fuel, fluid resistance decreases as the number of through holes is increased and as the cross-sectional area of each through hole is increased, and a decrease in fluid resistance has a significant effect on shortening a valve opening lag time.

Thus, the number of through holes in the anchor 102 and the cross-sectional area of each of the through holes have an influence on the area of the upper end face 122 in terms of changes in magnetic attraction force and valve opening lag time. Since there is a trade-off in the correlation noted above, it is required to carry out designing practice so as to provide the most advantageous effect.

Figure 5:
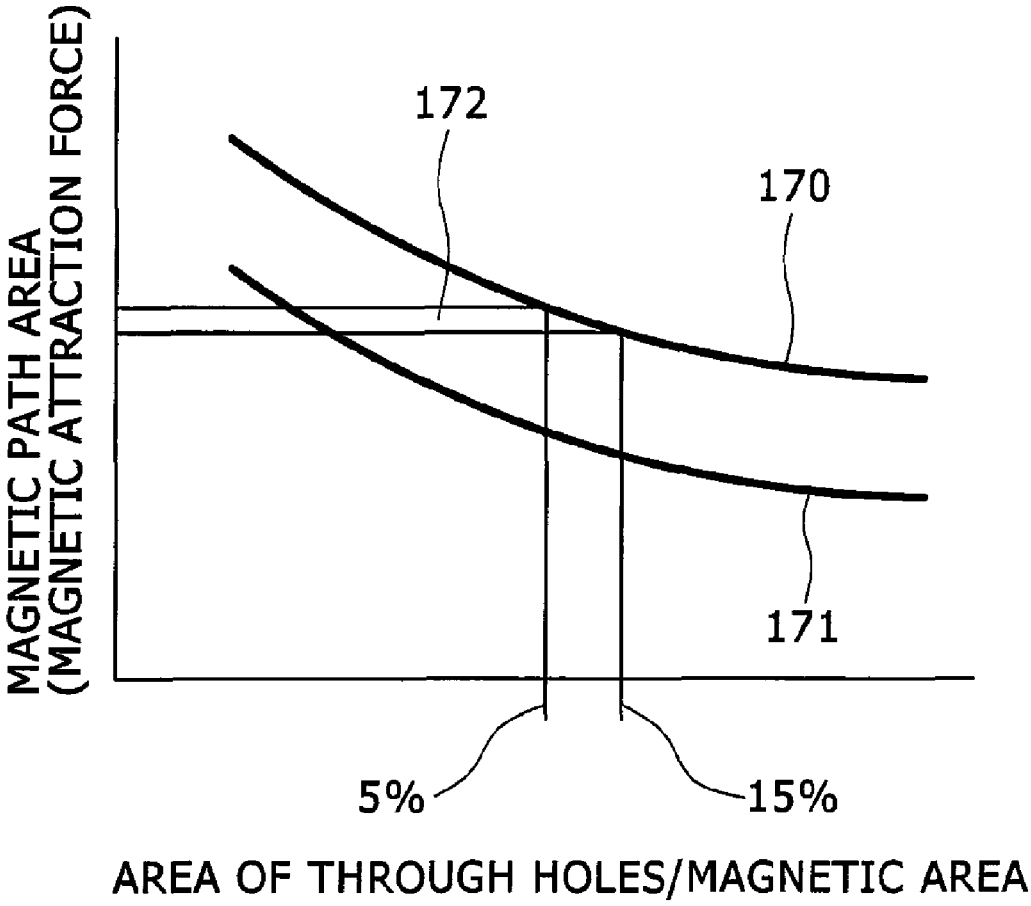
FIG. 5 is a graph showing the characteristics of magnetic attraction of the anchor.

With reference to FIG. 5, there is shown a graph of experimental results of measurements conducted by the inventors, indicating a ratio of the sum total of magnetic path areas of the through holes 150A, 152A, and 153A to the magnetic path area (magnetic attraction force) of the upper end face 122 of the anchor 102.

In comparison between a characteristic 170 of a fuel injection valve designed according to the present invention and a characteristic 171 of a conventional fuel injection valve, an improvement is found in the magnetic path (magnetic attraction force) in the fuel injection valve according to the present invention.

A magnetic area (magnetic attraction force) required for the characteristic 170 corresponds to a range of the characteristic 170 in design, and it has been verified that the ratio of the sum total of magnetic path areas of the through holes to the magnetic path area of the anchor 102 is 5% to 15%.

Figure 6:
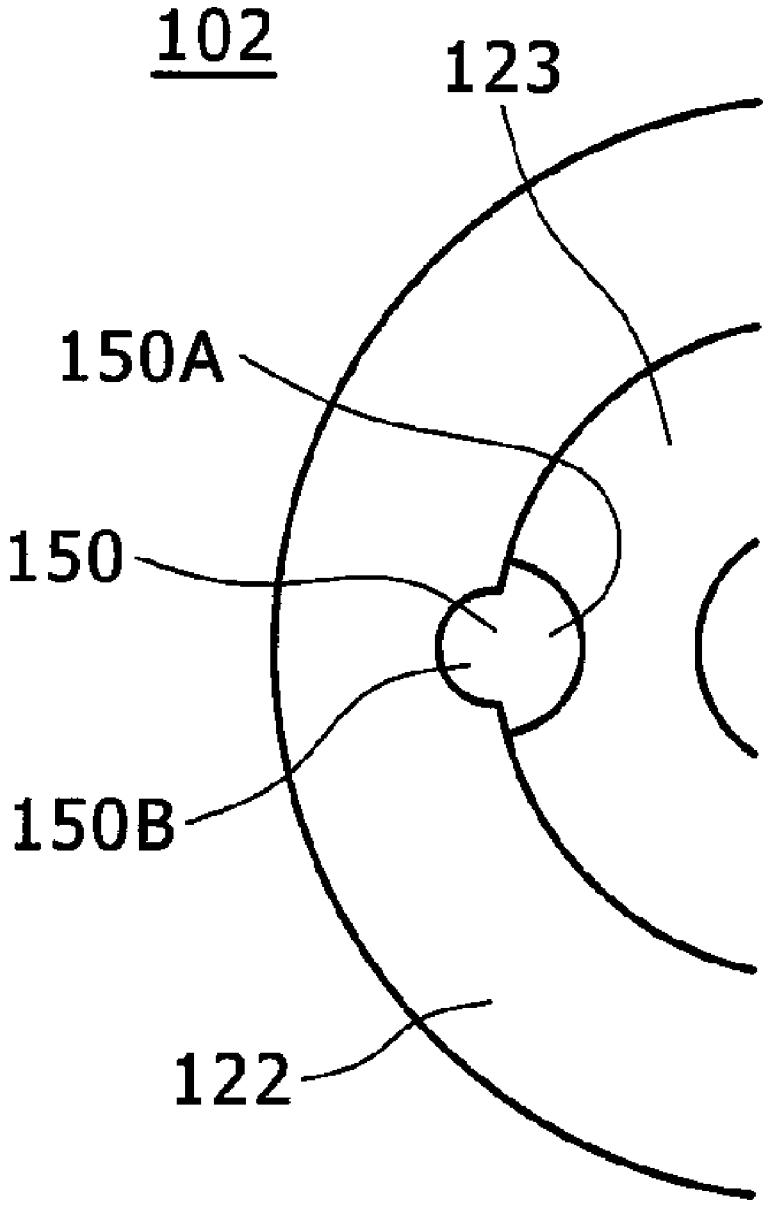
FIG. 6 is a plan view showing an anchor in another preferred embodiment of the present invention.

FIG. 6 shows another structure of fuel paths in communication with each other in the anchor 102 according to another preferred embodiment of the present invention.

In the structural arrangement of the through hole 150 for fuel flowing through the anchor 150 shown in FIG. 3, the through hole 150A on the downstream side viewed from the recessed part 123 where the lower end face of the plunger head part 114C is disposed has the same diametrical dimension of that of the vertical groove 150B having a semicircular cross section on the inner circumferential face of the recessed part 123 on the upstream side in the anchor. By way of contrast, in the structural arrangement of the through hole 150 shown in FIG. 6, the vertical groove 150B having a semicircular cross section on the inner circumferential face of the recessed part 123 on the upstream side in the anchor has a diametrical dimension smaller than that of the through hole 150A on the downstream side for provision of path communication.

Conversely, with respect to the structural arrangement shown in FIG. 6, the through hole 150A on the downstream side may have a diametrical dimension smaller than that of the vertical groove 150B having a semicircular cross section on the inner circumferential face of the recessed part 123 on the upstream side in the anchor for provision of path communication.

While the center lines of the two fuel paths in the anchor 102 shown in FIGS. 3 and 6 are aligned, there may also be provided a modified arrangement in which the center lines of the two fuel paths are disposed to deviate from each other for provision of path communication.

As mentioned above, a structural arrangement for communicating flow paths is to be determined in consideration of a trade-off between the magnetic path area of the upper end face 122 of the anchor to be subjected to magnetic attraction and the degree of lag in valve closing operation along with the workability of material of the anchor 102.

Further, while the preferred embodiments of the present invention have been described as related to the arrangement in which each of the through holes 150A, 151A, 152A, and 153A of the through hole 150 on the downstream side viewed from the bottom face 123A of the recessed part 123 is formed in a cylindrical shape, and each of the vertical grooves 150B, 151B, 152B, and 153B having a semicircular cross section on the inner circumferential face of the recessed part 123 on the upstream side in the anchor is formed by providing a circular-arc shape on the side face of the bottom face 123A of the recessed part 123, it is to be understood that the configurations of the through holes 150A to 153A and the vertical grooves 150B to 153B are not limited to cylindrical and circular-arc shapes, i.e., the cross sections thereof may be rectangular or elliptic.

The functional features and advantageous effects described hereinabove make it possible to enhance the responsivity of the fuel injection valve, and more particularly to shorten a valve closing lag time thereof. It follows therefore that a minimum injection limit controllable by the fuel injection valve can be decreased, e.g., when an engine is in idling, a fuel injection quantity thereof can be decreased to reduce fuel consumption. Further, even in cases where fuel is injected a plurality of times per engine stroke, it is allowed to divide a necessary fuel injection quantity into small proportions of fuel injection.

Figure 7:
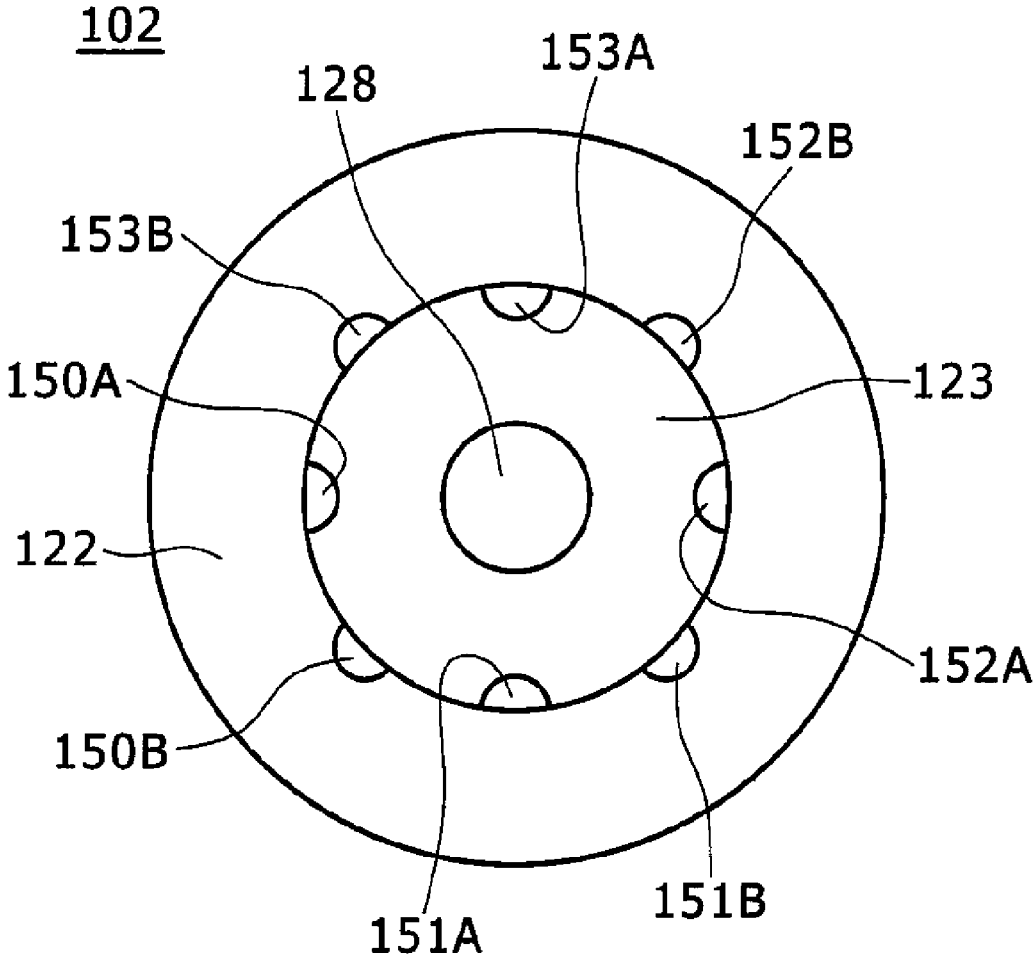
FIG. 7 is a plan view of an anchor in another preferred embodiment of the present invention.

FIG. 7 shows a structural arrangement of the anchor 102 in another preferred embodiment of the present invention.

In the structural arrangement of the anchor 102 shown in FIG. 7, each of the through holes 150A, 151A, 152A, and 153A on the counterflow upstream side with respect to the bottom face 123A of the recessed part 123 where the lower end face of the plunger head part 114C is disposed and each of the vertical grooves 150B, 151B, 152B, and 153B having a semicircular cross section on the inner circumferential face of the recessed part 123 on the counterflow downstream side in the anchor are formed at different positions without being in communication with each other.

Fuel running out of each of the through holes 150A, 151A, 152A, and 153A is fed to the periphery of the bottom face 123A of the recessed part 123 in the anchor and then drawn into the magnetic attraction gap 136 through each of the vertical grooves 150B, 151B, 152B, and 153B having a semicircular cross section on the inner circumferential face of the recessed part 123 in the anchor.

In the present preferred embodiment, fuel is fed along the side face of the spring bracket seat 117 of the movable member 114 and also fed through each of the vertical grooves 150B, 151B, 152B, and 153B having a semicircular cross section on the inner circumferential face of the recessed part 123 in the anchor, thereby bringing about an advantageous effect of shortening a valve closing lag time.

The preferred embodiments of the invention described so far are digested below:

In the design of an internal combustion engine using a fuel injection valve, it is desired to decrease a controllable minimum injection limit in fuel injection quantity since an excessive quantity of fuel injection in such a state as engine idling is a cause of worsening fuel economy. Further, in an internal combustion engine of a cylinder direct injection type, an improved formation of an air-fuel mixture can be made by injecting fuel a plurality of times per engine stroke, thereby reducing fuel consumption and exhaust emission of HC and NOx. To realize repetitive actions of fuel injection per stroke in a constant total quantity of fuel injection, it is required to inject fuel on the basis of measurement of a smaller volume of injection.

For forming a fuel injection valve having a small value of measurable and controllable fuel injection quantity (minimum injection limit), valve opening and closing actions of the fuel injection valve should be performed at a higher speed. In a technique for implementing higher-speed actions of valve opening and closing in an electromagnetic type of fuel injection valve, there is provided an arrangement in which the electromagnetic responsivity of the valve is made faster and also an intense force of magnetic attraction is produced while a preset load of a biasing spring is increased so as to apply a larger biasing force at the time of valve closing.

In another technique for accomplishing the above-mentioned purpose, there is provided an arrangement in which movement of fuel flowing into a gap S1 between a stationary core and an anchor exerting a force of valve opening and closing is smoothened to reduce fluid resistance to the anchor, thereby suppressing an obstructive force applied to valve actions.

According to a conventional technique for an electromagnetic type of fuel injection valve, a vertical groove is provided on a side face of an anchor or on a sliding guide face for the anchor to reduce fluid resistance to the anchor. In the electromagnetic type of fuel injection valve, a magnetic passage is formed between the side face of the anchor and the sliding guide face. Therefore, the provision of the vertical groove on the side face of the anchor or on the sliding guide face is equivalent to the provision of a wide gap across a passage of magnetic flux, resulting in a possible decrease in magnetic attraction force. In particular, the force of magnetic attraction is likely to decrease in cases where the vertical groove is widened with the intention of improving the responsivity of valve opening and closing.

Further, according to another conventional technique, there is provided a structure in which a vertical groove is formed as a fuel path for reducing fluid resistance in addition to a primary fuel path formed in an anchor. The primary fuel path formed in the anchor has the largest cross-sectional area than any other fuel paths and therefore provides the smallest fluid resistance. However, in this structure according to the conventional technique, the primary fuel path serves only for fluid passage, not providing a satisfactory function for facilitating fuel movement into a gap between the anchor and a stationary core. Therefore, there is a disadvantage that the effect of fluid resistance reduction by the vertical groove having a smaller cross-sectional area than the primary fuel path is not necessarily adequate on the side of the anchor.

In the fuel injection valve according to the above-mentioned preferred embodiments of the present invention, the toroidal coil is energized to apply a magnetic flux to the magnetic path including the anchor and the stationary core so that a force of magnetic attraction is produced in the magnetic attraction gap between the end face of the anchor and the end face of the stationary core, thereby attracting the anchor toward the stationary core. Thus, the valve disc to which the magnetic attraction force is transmitted from the anchor is made to come off the valve seat, thereby opening the fuel path for fuel injection.

In the structure of the fuel injection valve according to the above-mentioned preferred embodiments of the present invention, the stationary core is secured to the inside of the metallic pipe, the anchor is disposed to be opposed to the stationary core via the magnetic attraction gap so that the anchor can reciprocate between a position corresponding to the valve seat and a position corresponding the stationary core in the metallic pipe, the toroidal coil is disposed on the outside of the metallic pipe, the yokes are provided around the upper, lower and circumferential parts of the toroidal coil, the anchor has a plurality of through holes extending in the axial direction, and the outer side face of each of the through holes with respect to the axis of the fuel injection valve is located at an outer position radially outward from the side face of the fuel path formed at an approximately center position of the stationary core.

Further, each of the through holes noted above is provided with a fuel feed path on the stationary core side of the anchor so that fuel can be received from the side of the through hole.

In the fuel injection valve according to the above-mentioned embodiments of the present invention, fluid resistance on fuel passage can be decreased to allow movement of the anchor at a higher speed, thereby making it possible to shorten a valve closing lag time.

Figure 8:
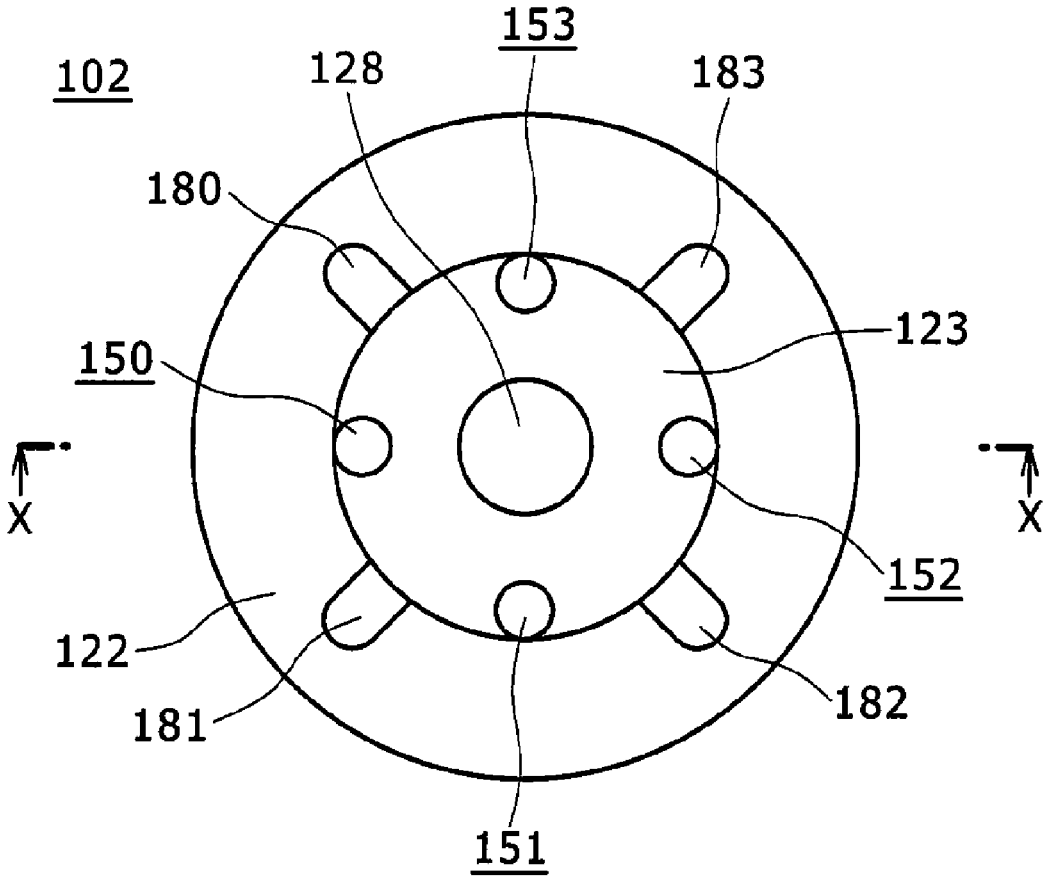
FIG. 8 is a plan view showing an anchor in another embodiment of the present invention.

Referring to FIG. 8, the following describes an another preferred embodiment of the present invention.

In the preferred embodiment shown in FIG. 8, the through holes 150 to 153 are formed at equally spaced intervals on the bottom face 123A of the recessed part 123 of the anchor 102, and fuel feed grooves 180 to 183 are disposed radially from the recessed part 123 on the end face of the anchor. At the time of downward movement of the anchor, the fuel feed grooves 180 to 183 serve to quickly feed fuel from the recessed part 123 to the magnetic gap 136. The through holes 150 to 153 serve to smoothly move fuel from the fuel path 118 to the recessed part 123 as in the foregoing preferred embodiments.

According to the present preferred embodiment, there may be provided an arrangement in which the through holes for promoting fluid flowing in the axial direction and the fuel paths for guiding fluid in the radial direction are disposed separately.

In addition, a through hole may be formed in the axial direction on the fuel feed grooves 180 to 183.

Figure 9:
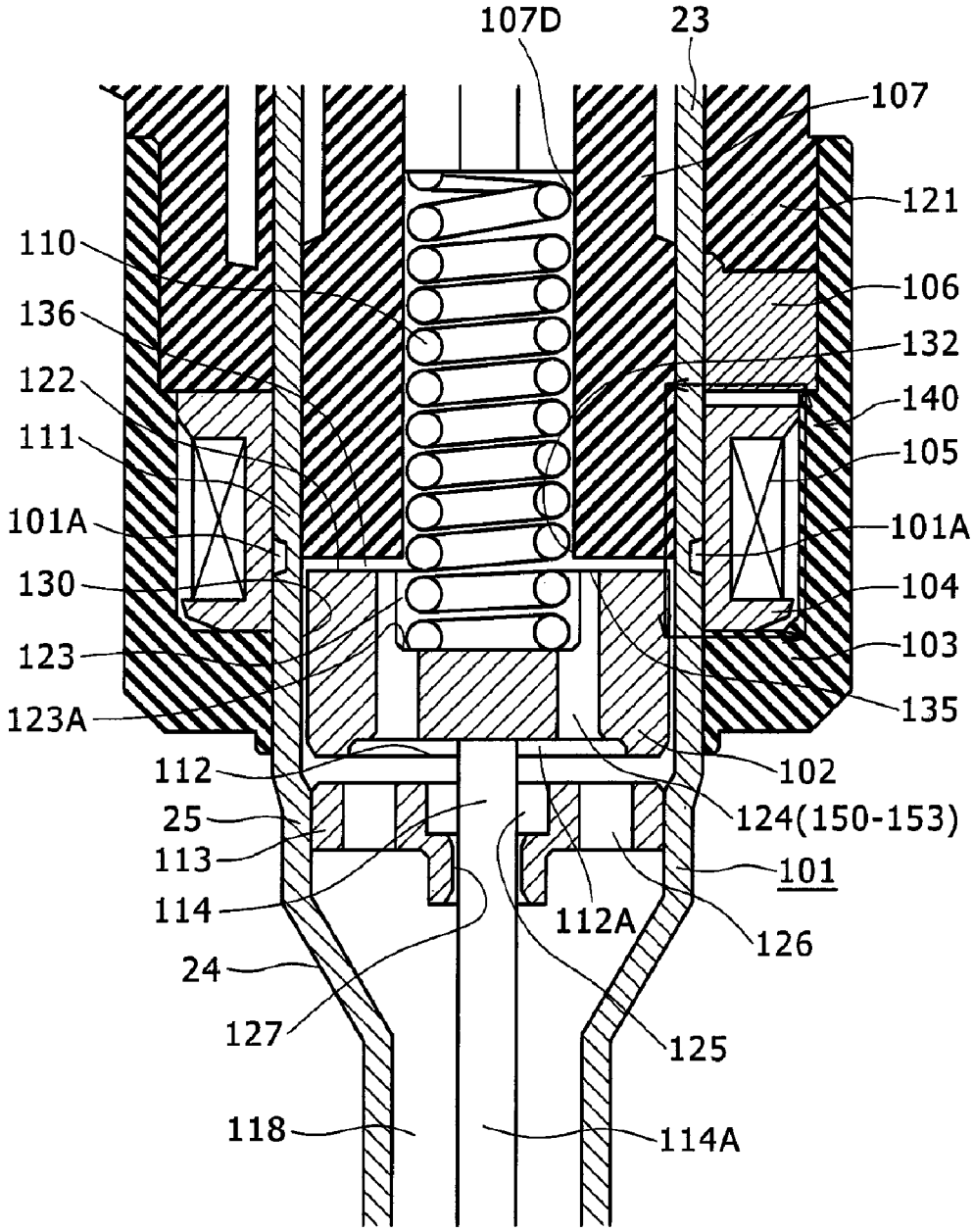
FIG. 9 is an enlarged fragmentary sectional view showing a part of a fuel injection valve in another preferred embodiment of the present invention.

Further, with reference to FIG. 9, the following describes an another preferred embodiment of the present invention.

In the preferred embodiment shown in FIG. 9, the plunger 114A is secured to the anchor 102 by welding for example, and the anchor 102 and the plunger 114A are thus moved together in any state of operation.

In this structural arrangement, the same advantageous effects as those in the foregoing preferred embodiments can be attained by providing the recessed part 123 at the center of the anchor 102 and forming the through holes and grooves on the bottom face and the inner circumferential face of the recessed part as described with reference to FIG. 2.

It is to be noted that, in FIGS. 1, 2 and 3, reference numeral 101A indicates a groove formed on the periphery of the metallic pipe 101, and a thin wall part 111 corresponding to the groove 101A constitutes a magnetic aperture in the magnetic passage.

As regards industrial applicability of the present invention, the fuel injection valve in accordance with the present invention is applicable to injection of any kind of fuel including gasoline, light oil, alcohol or the like used for internal combustion engines.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A fuel injection valve comprising:

an anchor having a cylindrical shape;

a plunger located at a center part of said anchor;

a valve disc disposed at a top end part of said plunger;

a stationary core having a fuel introduction bore for introducing fuel centerward; and an electromagnetic coil for applying a magnetic flux to a magnetic path including a magnetic attraction gap formed between an end face part of said anchor and an end face part of said stationary core;

the arrangement of said fuel injection valve being such that a force of magnetic attraction is produced between said end face part of said anchor and said end face part of said stationary core by said magnetic flux that passes through said magnetic gap, said force of magnetic attraction being used to attract said anchor to said stationary core for driving a movable member;

whereby said valve disc is moved off a valve seat thereof to open a fuel path provided on said valve seat;

wherein said anchor of said fuel injection valve comprises:

a recessed part formed, on a center part of said anchor, at a position opposed to an end part of said fuel introduction bore in said stationary core; and a plurality of through holes extending axially through said anchor in a fashion that each of said plurality of through holes is open to a periphery part of said plunger;

wherein a part of a fuel entry of each said through hole is open to a bottom face part of said recessed part, and the remaining part of said fuel entry of said each through hole is open to an end face part of said anchor; and wherein a part of each said through hole is formed on an inner circumferential face part of said recessed part of said anchor, and each said through hole is extended axially in a fashion that each said through hole penetrates from a bottom part of said recessed part to an end face part opposite to the stationary core side of said anchor.

2. A fuel injection valve comprising:

an anchor having a cylindrical shape;

a plunger located at a center part of said anchor;

a valve disc disposed at a top end part of said plunger;

a stationary core having a fuel introduction bore for introducing fuel centerward; and an electromagnetic coil for applying a magnetic flux to a magnetic path including a magnetic attraction formed between an end face part of said anchor and an end face part of said stationary core;

the arrangement of said fuel injection valve being such that a force of magnetic attraction is produced between said end face part of said anchor and said end face part of said stationary core by said magnetic flux that passes through said magnetic gap, said force of magnetic attraction being used to attract said anchor to said stationary core for driving a movable member;

whereby said valve disc is moved off a valve seat thereof to open a fuel path provided on said valve seat;

wherein said anchor of said fuel injection valve comprises:

a recessed part formed, on a center part of said anchor, at a position opposed to an end part of said fuel introduction bore in said stationary core; and a plurality of through holes extending axially through said anchor in a fashion that each of said plurality of through holes is open to a periphery part of said plunger;

wherein a part of a fuel entry of each said through hole is open to a bottom face part of said recessed part, and the remaining part of said fuel entry of said each through hole is open to an end face part of said anchor; and wherein at least one of said plurality of through holes has a fuel entry on an end face part of said anchor, and the remaining through holes have a fuel entry on a bottom face part of said recessed part.

3. A fuel injection valve comprising:

an anchor having a cylindrical shape;

a plunger located at a center part of said anchor;

a valve disc disposed at a top end part of said plunger;

a stationary core having a fuel introduction bore for introducing fuel centerward; and an electromagnetic coil for applying a magnetic flux to a magnetic path including a magnetic attraction gap formed between an end face part of said anchor and an end face part of said stationary core;

the arrangement of said fuel injection valve being such that a force of magnetic attraction is produced between said end face part of said anchor and said end face part of said stationary core by said magnetic flux that passes through said magnetic gap, said fence of magnetic attraction being used to attract said anchor to said stationary core for driving a movable member;

whereby said valve disc is moved off a valve seat thereof to open a fuel path provided on said valve seat;

wherein said anchor of said fuel injection valve comprises:

a recessed part formed, on a center part of said anchor, at a position opposed to an end part of said fuel introduction bore in said stationary core; and a plurality of through holes extending axially through said anchor in a fashion that each of said plurality of through holes is open to a periphery part of said plunger;

wherein a part of a fuel entry of each said through hole is open to a bottom face part of said recessed part, and the remaining part of said fuel entry of said each through hole is open to an end face part of said anchor;

wherein a plunger through hole for penetration of said plunger is formed at a center part of said recessed part of said anchor;

wherein a spring bracket seat for holding an end of a spring that exerts a biasing force on said plunger for movement thereof toward said valve seat is formed on said plunger;

wherein said anchor and said plunger are operatively associated so that said anchor, and said plunger are moved axially in conjunction with each other when said anchor is attracted to said stationary core; and wherein the sum total of the cross-sectional areas of said plurality of through holes is larger than the cross-sectional area of said plunger through hole.

4. A fuel injection valve comprising:

an anchor having a cylindrical shape;

a plunger located at a center part of said anchor;

a valve disc disposed at a top end part of said plunger;

a stationary core having a fuel introduction bore for introducing fuel centerward; and an electromagnetic coil for applying a magnetic flux to a magnetic path including a magnetic attraction gap formed between an end face part of said anchor and an end face part of said stationary core;

the arrangement of said fuel injection valve being such that a fore of magnetic attraction is produced between said end face part of said anchor and said end face part a said stationary core by said magnetic flux that passes through said magnetic gap, said force of magnetic attraction being used to attract said anchor to said stationary core for driving a movable member;

whereby said valve disc is moved off a valve seat thereof to open a fuel path provided on said valve seat;

wherein said anchor of said fuel injection valve comprises:

a recessed part formed, on a center part of said anchor, at a position opposed to an end part of said fuel introduction bore in said stationary core; and a plurality of through holes extending axially through said anchor in a fashion that each of said plurality of through holes is open to a periphery part of said plunger; and wherein a part of a fuel entry of each said through hole is open to a bottom face part of said recessed part, and the remaining part of said fuel entry of said each through hole is open to an end face part of said anchor;

wherein a plunger through hole for penetration of said plunger is formed at a center part of said recessed part of said anchor;

wherein a spring bracket seat for holding an end of a spring that exerts a biasing force on said plunger for movement thereof toward said valve seat is formed on said plunger;

wherein said anchor and said plunger are operatively associated so that said anchor and said plunger are moved in conjunction with each other when said anchor is attracted to said stationary core; and wherein the sum total of the cross-sectional areas of said plurality of through holes is larger than the minimum cross-sectional area of a fuel path formed between the outer circumference of said spring bracket seat formed on said plunger and the inner circumference of said stationary core.

* * * * *